US009661705B1

(12) United States Patent
Tseng

(10) Patent No.: US 9,661,705 B1
(45) Date of Patent: May 23, 2017

(54) POWER CONVERSION APPARATUS FOR DECREASING NUMBER OF PINS

(71) Applicant: Power Forest Technology Corporation, Hsinchu County (TW)

(72) Inventor: Yang-Tai Tseng, Hsinchu (TW)

(73) Assignee: Power Forest Technology Corporation, Hsinchu County (TW)

( * ) Notice: Subject to any disclaimer, the term of this patent is extended or adjusted under 35 U.S.C. 154(b) by 0 days.

(21) Appl. No.: 15/172,160

(22) Filed: Jun. 3, 2016

(30) Foreign Application Priority Data

May 17, 2016 (TW) ..... 105115126 A

(51) Int. Cl.
*H05B 41/28* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0845; H05B 33/0851; H05B 33/0827; H05B 33/0812; H05B 33/0884; H05B 33/0866; H05B 33/0863; H05B 41/2828; H05B 41/3921
USPC ..... 315/DIG. 4, 247, 224, 225, 209 R, 291, 315/307–326
See application file for complete search history.

(56) References Cited

U.S. PATENT DOCUMENTS

2011/0062887 A1* 3/2011 Hsu ..... H05B 33/0818 315/294
2011/0127921 A1* 6/2011 Lin ..... H05B 33/0827 315/192
2011/0309758 A1* 12/2011 Yu ..... H05B 33/0827 315/192
2012/0001561 A1* 1/2012 Balakrishnan ..... H05B 33/0815 315/209 R
2012/0181950 A1* 7/2012 Yu ..... H05B 33/0815 315/294
2013/0044272 A1* 2/2013 Gao ..... H05B 33/0815 349/61
2013/0250215 A1* 9/2013 Sasaki ..... H05B 33/0815 349/69

FOREIGN PATENT DOCUMENTS

TW 201422053 6/2014

OTHER PUBLICATIONS

"Office Action of Taiwan Counterpart Application", issued on Dec. 6, 2016, p. 1-p. 4, in which the listed reference was cited.

* cited by examiner

*Primary Examiner* — Tuyet Vo
(74) *Attorney, Agent, or Firm* — Jianq Chyun IP Office

(57) ABSTRACT

A power conversion apparatus including a power conversion circuit, a light-emitting unit and a control chip is provided. The control chip has a multi-function pin and a feedback pin, where the multi-function pin and the feedback pin respectively receive a dimming signal and a feedback signal reflecting an output current of the light-emitting unit, and the control chip determines whether to generate a PWM signal to a power switch of the power conversion circuit according to the dimming signal and the feedback signal based on a duty ratio of the dimming signal.

6 Claims, 2 Drawing Sheets

POWER CONVERSION APPARATUS FOR DECREASING NUMBER OF PINS

CROSS-REFERENCE TO RELATED APPLICATION

This application claims the priority benefits of Taiwan application serial no. 105115126, filed on May 17, 2016. The entirety of the above-mentioned patent application is hereby incorporated by reference herein and made a part of this specification.

BACKGROUND OF THE INVENTION

Field of the Invention

The invention relates to an electronic apparatus, and particularly relates to a power conversion apparatus.

Description of Related Art

In recent years, along with quick development of liquid-crystal displays (LCD), a light-emitting diode (LED) backlight source has gradually replaced a conventional cold-cathode fluorescent lamp (CCFL) backlight source. Moreover, regarding a control chip used for controlling lighting of LED, the number of pins thereof tends to be decreased due to consideration of a product volume, manufacturing cost, etc. Therefore, how to decrease the number of pins of the control chip while maintaining a normal operation becomes an important issue of the field.

SUMMARY OF THE INVENTION

The invention is directed to a power conversion apparatus, in which the number of pins of a control chip is decreased while a normal operation of the power conversion apparatus is maintained.

The invention provides a power conversion apparatus including a power conversion circuit, a light-emitting unit and a control chip. The power conversion circuit is used for converting an input voltage into an output voltage, and the power conversion circuit has a power switch, where a control terminal of the power switch receives a pulse width modulation (PWM) signal, and the power switch switches a self conduction state according to the PWM signal to convert the input voltage into the output voltage. The light-emitting unit is coupled to the power conversion circuit, and receives the output voltage to emit light. The control chip is coupled to the power conversion circuit and the light-emitting unit, and has a multi-function pin and a feedback pin, where the multi-function pin and the feedback pin respectively receive a dimming signal and a feedback signal reflecting an output current of the light-emitting unit, and the control chip determines whether to generate the PWM signal according to the dimming signal and the feedback signal based on a duty ratio of the dimming signal.

In an embodiment of the invention, when the duty ratio of the dimming signal is smaller than a predetermined value or the control chip does not receive the dimming signal for a predetermined period of time, the control chip enters a low power mode and stops generating the PWM signal, and when the duty ratio of the dimming signal is greater than or equal to the predetermined value, the control chip is enabled to generate the PWM signal.

In an embodiment of the invention, the control chip includes a dimming detection circuit, which is coupled to the multi-function pin, and converts the dimming signal into a pulse voltage signal or an analog voltage signal. An enable circuit is coupled to the multi-function pin, and determines whether the duty ratio of the dimming signal is smaller than a predetermined value or whether the multi-function pin does not receive the dimming signal for a predetermined period of time, when the duty ratio of the dimming signal is smaller than the predetermined value or the multi-function pin does not receive the dimming signal for the predetermined period of time, the control chip enters a low power mode and stops generating the PWM signal, and when the duty ratio of the dimming signal is not smaller than the predetermined value, the enable circuit enables the dimming detection circuit to convert the dimming signal into the pulse voltage signal or the analog voltage signal.

In an embodiment of the invention, the control chip further includes a transconductance amplifier, a positive input terminal and a negative input terminal of the transconductance amplifier are respectively coupled to the dimming detection circuit and the feedback pin, and the transconductance amplifier generates a transconductance amplifying signal according to the feedback signal and the pulse voltage signal or the analog voltage signal. A PWM signal generation circuit is coupled to an output terminal of the transconductance amplifier, and generates the PWM signal according to the transconductance amplifying signal and a reference signal.

In an embodiment of the invention, the power conversion apparatus further includes a current detection circuit and an overvoltage detection circuit. The current detection circuit is coupled to the power switch, and detects a current flowing through the power switch to output a current detection signal to a current/overvoltage detection pin of the control chip, and the control chip further adjusts the PWM signal according to the current detection signal. The overvoltage detection circuit is coupled to the power conversion circuit and the current/overvoltage detection pin, and detects an overvoltage appeared in the voltage conversion circuit to output an overvoltage detection signal to the current/overvoltage detection pin, and the control signal executes an overvoltage protection operation according to the overvoltage detection signal.

In an embodiment of the invention, the power conversion apparatus further includes a feedback circuit, which is coupled to the light-emitting unit and the feedback pin, and provides the feedback signal to the feedback pin in response to the output current of the light-emitting unit.

In an embodiment, of the invention, the light-emitting unit is a light-emitting diode.

According to the above description, the control chip of the power conversion apparatus of the invention may determine whether to generate the PWM signal according to the dimming signal and the feedback signal based on the duty ratio of the dimming signal, so that a dimming signal pin and an enable pin of the prior art are integrated into one multi-function pin. In this way, the number of pins of the control chip is decreased without influencing the normal operation of the power conversion apparatus.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
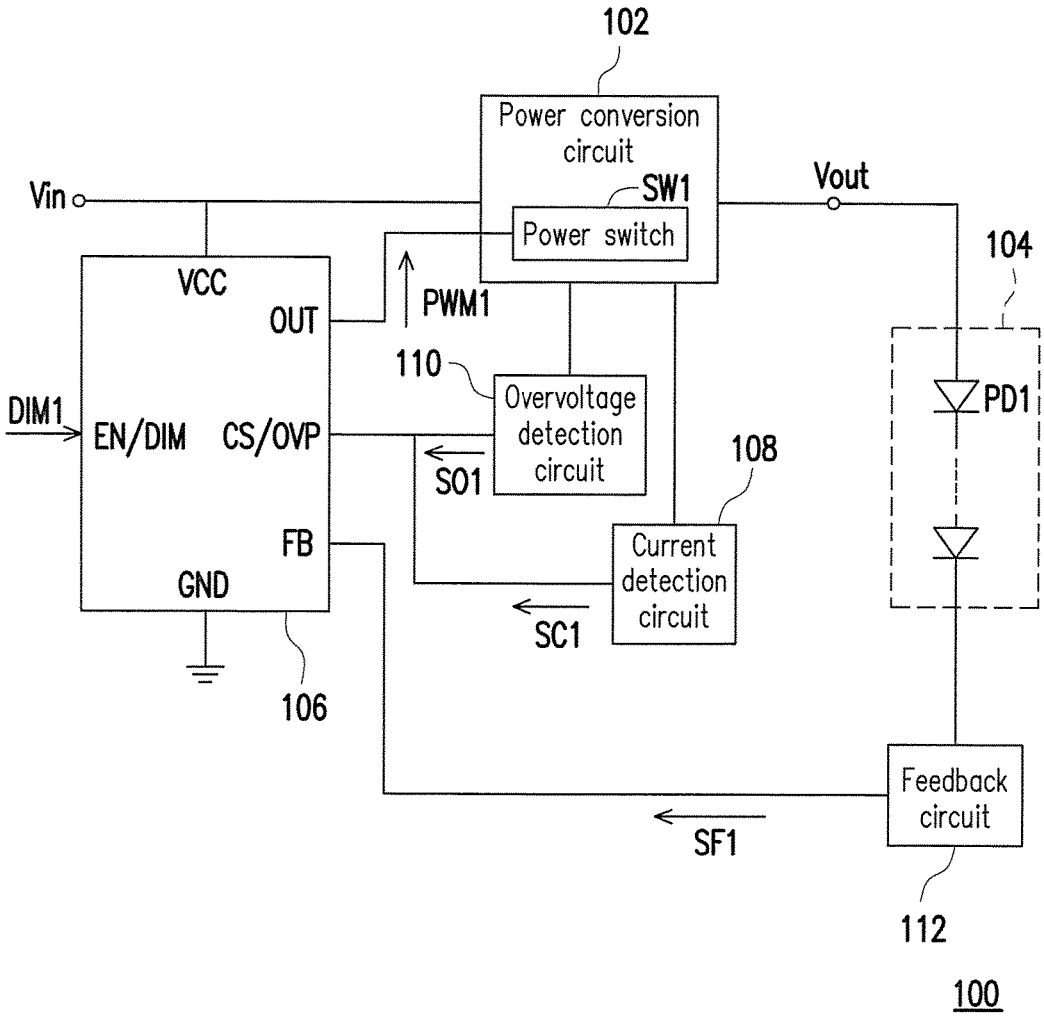
FIG. 1 is a schematic diagram of a power conversion apparatus according to an embodiment of the invention.

FIG. 1 is a schematic diagram of a power conversion apparatus according to an embodiment of the invention. Referring to FIG. 1, the power conversion apparatus 100 includes a power conversion circuit 102, a light-emitting unit 104, a control chip 106, a current detection circuit 108, an overvoltage detection circuit 110 and a feedback circuit 112, where the control chip 106 has a power pin VCC, an output pin OUT, a multi-function pin EN/DIM, a feedback pin FB, a ground pin GND and a current/overvoltage detection pin CS/OVP. The power conversion circuit 102 is coupled to the output pin OUT, and is adapted to convert an input voltage Vin into an output voltage Vout. Further, the power conversion circuit 102 has a power switch SW1, where a control terminal of the power switch SW1 receives a pulse width modulation (PWM) signal PWM1, and the power switch SW1 switches a self conduction state according to the PWM signal PWM1 coming from the output pin OUT to convert the input voltage Vin into the output voltage Vout. The light-emitting unit 104 is coupled to the power conversion circuit 102 and the feedback circuit 112, and receives the output voltage Vout output by the power conversion circuit 102 to emit light. The light-emitting unit 104 can be implemented by a plurality of LEDs PD1 connected in series, as shown in FIG. 1, though the invention is not limited thereto. The feedback circuit 112 is coupled to the light-emitting unit 104 and the feedback pin FB, and provides a feedback signal SF1 to the feedback pin FB in response to an output current of the light-emitting unit 104.

The current detection circuit 108 is coupled to the power switch SW1 and the current/overvoltage detection pin CS/OVP. The current detection circuit 108 detects a current flowing through the power switch SW1 to output a current detection signal SC1 to the current/overvoltage detection pin CS/OVP of the control chip 106, and the control chip 106 adjusts a duty ratio of the PWM signal PWM1 according to the current detection signal SC1, so as to stabilize the output voltage Vout output to the light-emitting unit 104. The overvoltage detection circuit 110 is coupled to the power conversion circuit 102 and the current/overvoltage detection pin CS/OVP, and the overvoltage detection circuit 110 detects an overvoltage appeared in the voltage conversion circuit 102 to output an overvoltage detection signal SO1 to the current/overvoltage detection pin CS/OVP, and the control signal 106 executes an overvoltage protection operation according to the overvoltage detection signal SO1.

Moreover, the power pin VCC of the control chip 106 is coupled to the input voltage Vin to receive power required for normal operation of the control chip 106, and the ground pin GND of the control chip 106 is coupled to ground. Moreover, the multi-function pin EN/DIM of the control chip 106 receives a dimming signal DIM1, and the control chip 106 determines whether to generate the PWM signal PWM1 according to the dimming signal DIM1 and the feedback signal SF1 based on the duty ratio of the dimming signal DIM1. For example, when the duty ratio of the dimming signal DIM1 is smaller than a predetermined value or the control chip 106 does not receive the dimming signal Dim1 for a predetermined period of time, the control chip 106 enters a low power mode and stops generating the PWM signal PWM1, and when the duty ratio of the dimming signal DIM1 is greater than or equal to the predetermined value, the control chip 106 is enabled to generate the PWM signal PWM1.

By determining whether to control the control chip 106 to enter the low power mode according to the duty ratio of the dimming signal DIM1 or not to enter the low power mode but generate the PWM signal PWM1 according to the dimming signal DIM1, a dimming signal pin and an enable pin of the prior art can be integrated into the multi-function pin EN/DIM of the present embodiment, i.e. the number of pins of the control chip 106 is decreased without influencing a normal operation of the power conversion apparatus 100, and the control chip 106 may still normally operate in case that the control chip 106 only has 6 pins.

Figure 2:
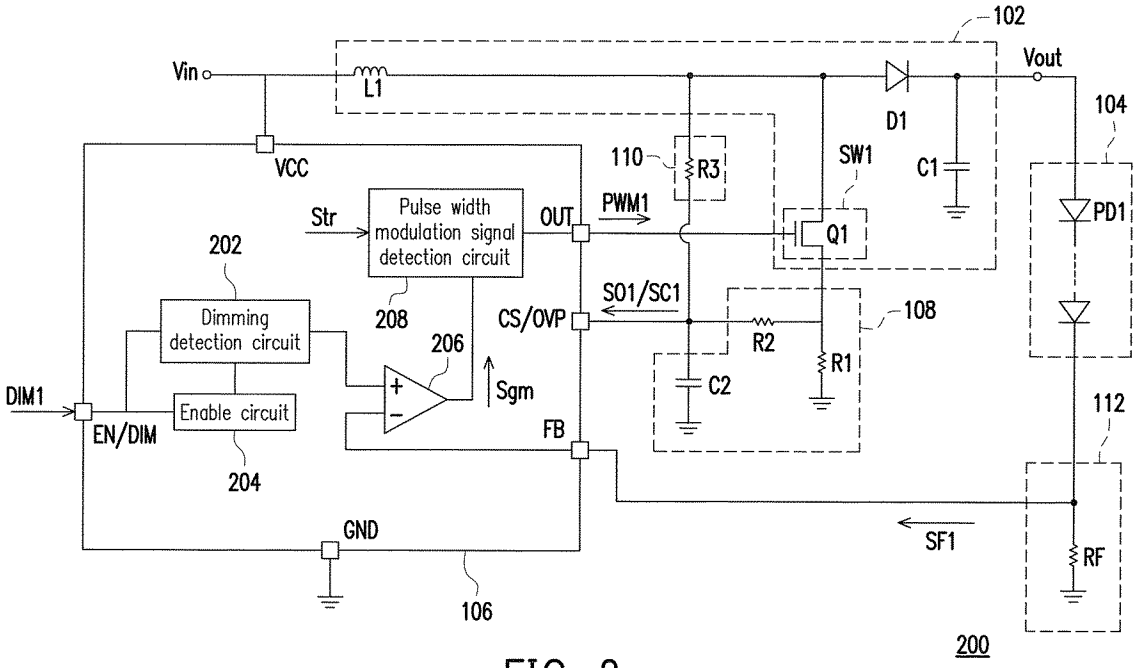
FIG. 2 is a schematic diagram of a power conversion apparatus according to another embodiment of the invention.

FIG. 2 is a schematic diagram of a power conversion apparatus according to another embodiment of the invention. Referring to FIG. 2, in detail, in the present embodiment, the power conversion circuit 102 of the power conversion apparatus 200 may include an inductor L1, a rectifying diode D1, a transistor Q1 and a capacitor C1, where the transistor Q1 is used for implementing the aforementioned power switch SW1, and a gate of the transistor Q1 is coupled to the output pin OUT, and a drain and a source of the transistor Q1 are respectively coupled to the inductor L1 and the current detection circuit 108. The inductor L1 is coupled between the input voltage Vin and the drain of the transistor Q1. An anode and a cathode of the rectifying diode D1 are respectively coupled to a common node of the inductor L1 and the transistor Q1 and an output terminal of the power conversion circuit 102. The capacitor C1 is coupled between the cathode of the rectifying diode D1 and the ground. When the transistor Q1 is turned on, the input voltage Vin crosses over the inductor L1, and current linearity of the inductor L1 is increased, and energy is stored in the inductor L1. When the transistor Q1 reaches a predetermined conduction time, the transistor Q1 is turned off, and the stored energy is output to the output terminal of the power conversion circuit 102 through the rectifying diode D1 and charge the capacitor C1. Through repeat alternation of the aforementioned operations, the input voltage Vin is improved to a level set by the output terminal of the power conversion circuit 102.

Moreover, in the present embodiment, the current detection circuit 108 includes resistors R1, R2 and a capacitor C2, where the resistor R1 is coupled between the source of the transistor and the ground, the resistor R2 is coupled between the source of the transistor Q1 and the current/overvoltage detection pin CS/OVP, and the capacitor C2 is coupled between the current/overvoltage detection pin CS/OVP and the ground, so as to detect a current flowing through the transistor Q1. The voltage detection circuit 110 includes a resistor R3, where the resistor R3 is connected in series between the anode of the rectifying diode D1 and the current/overvoltage detection pin CS/OVP, so as to detect whether an overvoltage is appeared in the power conversion circuit 102. The feedback circuit 112 includes a resistor RF, where the resistor RF is coupled between the light-emitting unit 104 and the ground, so as to generate a feedback signal SF1 to the feedback pin FB at a common node of the light-emitting unit 104 and the resistor RF.

Moreover, further, the control chip 106 may include a dimming detection circuit 202, an enable circuit 204, a transconductance amplifier 206 and a PWM signal generation circuit 208, where the dimming detection circuit 202 is coupled to the multi-function pin EN/DIM and a positive input terminal of the transconductance amplifier 206, and a negative input terminal of the transconductance amplifier 206 is coupled to the feedback pin FB. The enable circuit 204 is coupled to the multi-function pin EN/DIM and the dimming detection circuit 202, and the PWM signal generation circuit 208 is coupled to an output terminal of the transconductance amplifier 206 and the output pin OUT. The dimming detection circuit 202 may convert the dimming signal DIM1 into a pulse voltage signal or an analog voltage signal, and outputs the pulse voltage signal or the analog voltage signal to the positive input terminal of the transconductance amplifier 206. For example, the dimming detection circuit 202 may convert the dimming signal DIM1 into a pulse voltage signal only switching between two voltage levels of 300 mV and 0 mV, or convert the dimming signal DIM1 into an analog voltage signal (for example, 20 mV, 60 mV, 250 mV, etc.) varied along with the duty ratio of the dimming signal DIM1.

The enable circuit 204 may determine whether the duty ratio of the dimming signal DIM1 is smaller than a predetermined value or whether the multi-function pin EN/DIM does not receive the dimming signal DIM1 for a predetermined period of time. When the duty ratio of the dimming signal DIM1 is smaller than the predetermined value or the multi-function pin EN/DIM does not receive the dimming signal DIM1 for the predetermined period of time, the control chip 106 enters a low power mode and stops generating the PWM signal PWM1, and when the duty ratio of the dimming signal DIM1 is not smaller than the predetermined value, the enable circuit 204 enables the dimming detection circuit 202, and the dimming detection circuit 202 continually to convert the dimming signal DIM1 into the pulse voltage signal or the analog voltage signal.

The transconductance amplifier 206 may generate a transconductance amplifying signal Sgm according to the feedback signal SF1 and the pulse voltage signal or the analog voltage signal, and outputs the transconductance amplifying signal Sgm to the PWM signal generation circuit 208, and the PWM signal generation circuit 208 generates the PWM signal PWM1 according to the transconductance amplifying signal Sgm and a reference signal Str, where the reference signal Str is, for example, a triangular wave signal, a square wave signal, a sine wave signal, etc.

As described above, in the power conversion apparatus 200 of the present embodiment, besides that the number of pins of the control chip 106 can be decreased without influencing a normal operation of the power conversion apparatus 200, the dimming signal DIM1 can also be converted into the pulse voltage signal or the analog voltage signal by the dimming detection circuit 202, such that the transconductance amplifier 206 may generate the transconductance amplifying signal Sgm according to the feedback signal SF1 and the pulse voltage signal or the analog voltage signal. In this way, not only the control chip 106 may omit a transconductance pin used for adjusting a transconductance value in the conventional technique, but also the pulse voltage signal or the analog voltage signal can be provided to the transconductance amplifier 206 to perform transconductance amplifying, so that the user may have more circuit design choices without adding pins to the control chip 106.

In summary, the control chip of the power conversion apparatus of the invention may determine whether to generate the PWM signal according to the dimming signal and the feedback signal based on the duty ratio of the dimming signal, so that a dimming signal pin and an enable pin of the prior art are integrated into one multi-function pin. In this way, the number of pins of the control chip is decreased without influencing the normal operation of the power conversion apparatus. In some embodiments, the dimming signal can also be converted into the pulse voltage signal or the analog voltage signal by the dimming detection circuit, such that the transconductance amplifier may generate the transconductance amplifying signal according to the feedback signal and the pulse voltage signal or the analog voltage signal. In this way, not only the control chip may omit a transconductance pin used for adjusting a transconductance value in the conventional technique, but also the pulse voltage signal or the analog voltage signal can be provided to the transconductance amplifier to perform transconductance amplifying, so that the user may have more circuit design choices without adding pins to the control chip.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A power conversion apparatus, comprising:

a power conversion circuit, converting an input voltage into an output voltage, and having a power switch, wherein a control terminal of the power switch receives a pulse width modulation signal, and the power switch switches a self conduction state according to the pulse width modulation signal to convert the input voltage into the output voltage;

a light-emitting unit, coupled to the power conversion circuit, and receiving the output voltage to emit light;

a control chip, coupled to the power conversion circuit and the light-emitting unit, and having a multi-function pin and a feedback pin, wherein the multi-function pin and the feedback pin respectively receive a dimming signal and a feedback signal reflecting an output current of the light-emitting unit, and the control chip determines whether to generate the pulse width modulation signal according to the dimming signal and the feedback signal based on a duty ratio of the dimming signal;

a current detection circuit, coupled to the power switch, and detecting a current flowing through the power switch to output a current detection signal to a current/overvoltage detection pin of the control chip, wherein the control chip further adjusts the pulse width modulation signal according to the current detection signal; and an overvoltage detection circuit, coupled to the power conversion circuit and the current/overvoltage detection pin, and detecting an overvoltage appeared in the voltage conversion circuit to output an overvoltage detection signal to the current/overvoltage detection pin, such that the control signal executes an overvoltage protection operation according to the overvoltage detection signal.

2. The power conversion apparatus as claimed in claim 1, wherein when the duty ratio of the dimming signal is smaller than a predetermined value or the control chip does not receive the dimming signal for a predetermined period of time, the control chip enters a low power mode and stops generating the pulse width modulation signal, and when the duty ratio of the dimming signal is greater than or equal to the predetermined value, the control chip is enabled to generate the pulse width modulation signal.

3. The power conversion apparatus as claimed in claim 1, further comprising:

a feedback circuit, coupled to the light-emitting unit and the feedback pin, and providing the feedback signal to the feedback pin in response to the output current of the light-emitting unit.

4. The power conversion apparatus as claimed in claim 1, wherein the light-emitting unit is a light-emitting diode.

5. The power conversion apparatus as claimed in claim 1, wherein the control chip comprises:

a dimming detection circuit, coupled to the multi-function pin, and converting the dimming signal into a pulse voltage signal or an analog voltage signal; and an enable circuit, coupled to the multi-function pin, and determining whether the duty ratio of the dimming signal is smaller than a predetermined value or whether the multi-function pin does not receive the dimming signal for a predetermined period of time, wherein when the duty ratio of the dimming signal is smaller than the predetermined value or the multi-function pin does not receive the dimming signal for the predetermined period of time, the control chip enters a low power mode and stops generating the pulse width modulation signal, and when the duty ratio of the dimming signal is not smaller than the predetermined value, the enable circuit enables the dimming detection circuit to convert the dimming signal into the pulse voltage signal or the analog voltage signal.

6. The power conversion apparatus as claimed in claim 5, wherein the control chip further comprises:

a transconductance amplifier, wherein a positive input terminal and a negative input terminal of the transconductance amplifier are respectively coupled to the dimming detection circuit and the feedback pin, and the transconductance amplifier generates a transconductance amplifying signal according to the feedback signal and the pulse voltage signal or the analog voltage signal; and a pulse width modulation signal generation circuit, coupled to an output terminal of the transconductance amplifier, and generating the pulse width modulation signal according to the transconductance amplifying signal and a reference signal.

* * * * *